US009300059B2

(12) United States Patent
Endo et al.

(10) Patent No.: US 9,300,059 B2
(45) Date of Patent: Mar. 29, 2016

(54) PRESS-FIT TYPE CONNECTOR TERMINAL AND METHOD OF FABRICATING THE SAME

(71) Applicant: DAI-ICHI SEIKO CO., LTD., Kyoto (JP)

(72) Inventors: Takayoshi Endo, Shizuoka (JP); Sakai Yagi, Shizuoka (JP); Takuya Takeda, Shizuoka (JP)

(73) Assignee: DAI-ICHI SEIKO CO., LTD., Kyoto (JP)

( * ) Notice: Subject to any disclaimer, the term of this patent is extended or adjusted under 35 U.S.C. 154(b) by 0 days.

(21) Appl. No.: 14/449,279

(22) Filed: Aug. 1, 2014

(65) Prior Publication Data

US 2015/0044918 A1 Feb. 12, 2015

(30) Foreign Application Priority Data

Aug. 9, 2013 (JP) ..... 2013-166761

(51) Int. Cl.

| | |
|---|---|
| ***H01R 13/415*** | (2006.01) |
| ***H01R 4/48*** | (2006.01) |
| ***H01R 43/16*** | (2006.01) |
| ***H01R 12/58*** | (2011.01) |

(52) U.S. Cl.

CPC ..... *H01R 4/48* (2013.01); *H01R 12/585* (2013.01); *H01R 43/16* (2013.01); *Y10T 29/49204* (2015.01); *Y10T 428/12361* (2015.01)

(58) Field of Classification Search

CPC ..... H01R 4/48; H01R 43/16; H01R 12/585; H01R 13/415

USPC ..... 439/741, 49, 571, 595, 626, 733.1, 743, 439/751, 825, 887, 889

See application file for complete search history.

(56) References Cited

U.S. PATENT DOCUMENTS

| | | | | |
|---|---|---|---|---|
| 3,545,080 | A * | 12/1970 | Evans | H01R 13/052 24/618 |
| 4,769,907 | A * | 9/1988 | Sebastien | 29/874 |
| 5,078,612 | A | 1/1992 | Rozmus | |
| 5,487,684 | A * | 1/1996 | Schalk | H01R 12/585 439/751 |
| 6,231,402 | B1 * | 5/2001 | Kikuchi | H01R 12/585 439/751 |
| 7,025,639 | B2 * | 4/2006 | Aoki et al. | 439/751 |
| 7,030,325 | B2 * | 4/2006 | Blossfeld | H01H 1/5805 200/11 R |
| 8,325,493 | B2 * | 12/2012 | McClellan | H01R 12/7064 361/801 |
| 8,888,541 | B2 * | 11/2014 | Endo et al. | 439/751 |
| 8,968,010 | B2 * | 3/2015 | Endo et al. | 439/82 |

FOREIGN PATENT DOCUMENTS

| | | | |
|---|---|---|---|
| DE | 10 2010 024 526 | 12/2011 | |
| JP | 2012-169190 | 9/2012 | |
| JP | 2013-65543 | 4/2013 | |
| WO | 2008/038331 | 4/2008 | |
| WO | WO 2008038331 A1 * | 4/2008 | H01R 12/585 |

OTHER PUBLICATIONS

JP 2006318931. Saitoh Yasushi. Press Fit Terminal. (Translation for WO 2008038331A1).*

* cited by examiner

*Primary Examiner* — Amy Cohen Johnson
*Assistant Examiner* — Milagros Jeancharles
(74) *Attorney, Agent, or Firm* — Wenderoth, Lind & Ponack, L.L.P.

(57) ABSTRACT

A press-fit type connector terminal includes a contact section inserted into a through-hole of a printed circuit board, the press-fit connector terminal being formed of a single elastic metal sheet, the contact section including a plurality of contact pieces surrounding a longitudinal center line of the press-fit type connector terminal, and a pair of binders binding the plurality of contact pieces at opposite ends thereof, the pair of binders having a thickness that is smaller than a maximum thickness of the plurality of contact pieces.

17 Claims, 16 Drawing Sheets

PRESS-FIT TYPE CONNECTOR TERMINAL AND METHOD OF FABRICATING THE SAME

BACKGROUND OF THE INVENTION

1. Field of the Invention

The invention relates to a press-fit type connector terminal to be inserted into an electrically conductive through-hole formed through a printed circuit board, a method of fabricating the same, and a single elastic metal sheet of which the press-fit type connector terminal is fabricated.

2. Description of the Related Art

FIG. 15 illustrates a conventional press-fit type connector terminal having been suggested in Japanese Patent Application Publication No. 2013-65543.

The conventional press-fit type connector terminal illustrated in FIG. 15 is fabricated by bending a single elastic metal sheet 10*x* illustrated in FIG. 14. As illustrated in FIG. 15, the press-fit type connector terminal includes a pin section llx having a U-shaped cross-section, a central shaft section 12*x* extending from an end of the pin section 11*x*, a contact section 14*x* including a plurality of contact pieces 13*x*, and a pair of C-shaped binders 15*x* and 16*x* each binding the contact pieces 13*x* at their upper and lower ends and surrounding the central shaft section 12*x*. Each of the contact pieces 13*x* is centrally bent into a shape "<". The contact pieces 13*x* extend in a longitudinal direction L of the central shaft section 12*x*, and are bent to outwardly project such that the contact pieces 13*x* surround the central shaft section 12*x*.

Since the contact section 14*x* is inserted into an electrically conductive through-hole formed through a printed circuit board, the contact section 14*x* is designed to have a quite small diameter. Specifically, the contact section 14*x* has a diameter of about 1.7 mm. Furthermore, a through-hole of a printed circuit board is considered to be designed smaller and smaller in the future, and accordingly, the contact section 14*x* will be required to have a smaller diameter.

The press-fit type connector terminal illustrated in FIG. 15 is fabricated by punching and bending the single metal sheet 10*x* illustrated in FIG. 14. However, if the metal sheet 10*x* had a thickness of about 0.4 mm, it is quite difficult to bend a portion of the metal sheet 10*x* into the C-shaped arcuate binders 15*x* and 16*x* surrounding the central shaft portion 12*x* therewith.

SUMMARY OF THE INVENTION

In view of the above-mentioned problems in the conventional press-fit type connector terminal, it is an object of the present invention to provide a press-fit type connector terminal capable of keeping a contact pressure to be equal to the same of the conventional press-fit type connector terminal, and including a contact section having a reduced diameter.

It is another object of the present invention to provide a single elastic metal sheet used for fabricating the above-mentioned press-fit type connector terminal.

It is still another object of the present invention to provide a method of fabricating the above-mentioned press-fit type connector terminal.

In one aspect of the present invention, there is provided a press-fit type connector terminal including a contact section inserted into a through-hole of a printed circuit board, the connector terminal being formed of a single elastic metal sheet, the contact section including a plurality of contact pieces surrounding a longitudinal center line of the press-fit type connector terminal, and a pair of binders binding the contact pieces at their opposite ends, the binders having a thickness smaller than a maximum thickness of the contact pieces.

In the press-fit type terminal connector in accordance with the present invention, the binders are designed to have a thickness smaller than the same of the contact pieces. Thus, the binders can be readily bent. Accordingly, the contact section including the contact pieces can be designed to have a small diameter.

It is preferable that a thickness at a center of the contact pieces in a direction of the center line is greater than a thickness of the contact pieces at their opposite ends.

By designing the contact pieces to have such a thickness, the binders can be readily bent, and it is possible to avoid a contact load of the contact pieces from being reduced.

It is preferable that each of the contact pieces has a thickness decreasing to opposite ends thereof from a center thereof.

By designing the contact pieces to have such a tapered thickness, a thickness of each of the contact pieces does not drastically vary, but gradually varies, ensuring that stress concentration does not occur on the contact pieces.

It is preferable that an inclination angle in a thickness of each of the contact pieces from a center thereof to one of ends thereof is different from an inclination angle in a thickness of each of the contact pieces from a center thereof to the other end thereof.

It is preferable that the binders have a thickness equal to a thickness of the contact pieces at their ends.

This ensures that stress concentration does not occur at a boundary between the binders and the ends of the contact pieces.

It is preferable that the binders have a thickness smaller than a thickness of the contact pieces at their ends.

By designing the binders to have such a thickness, each of the contact pieces has a thickness greater than the same of the binders in a majority of portions of each of the contact pieces, and thus, it is possible to avoid a contact load of the contact pieces from being reduced.

It is preferable that a thickness is gradually reduced from a center of each of the contact pieces to the opposite ends of the binders.

By designing the contact pieces and the binders to have such a tapered thickness, the thickness not drastically vary, but gradually varies, ensuring that stress concentration does not occur on the contact pieces and the binders.

It is preferable that an inclination angle in a thickness from a center of each of the contact pieces to one of the opposite ends of the binders is different from an inclination angle in a thickness from a center of each of the contact pieces to the other of the opposite ends of the binders.

It is preferable that each of the contact pieces is arcuate with a center thereof being a summit.

It is preferable that each of the binders has a uniform thickness.

By designing the binders to have a uniform thickness, the binders can be readily bent, and stress concentration does not occur on the binders when the binders are bent, ensuring that the binders can have a sufficient strength after having been bent.

In another aspect of the present invention, there is provided a single elastic metal sheet of which the above-mentioned press-fit type connector terminal is fabricated, including a rectangular first area, a rectangular second area adjacent to an end of the first area in a longitudinal direction of the first area, commonly having a longitudinal center line with the first area, and having a width smaller than the same of the first area, a rectangular third area adjacent to an end of the second area in a longitudinal direction of the second area, having a side extending on an extension of a side of the second area, and having a width smaller than the same of the second area, a rectangular fourth area adjacent to an end of the third area in a longitudinal direction of the third area, and having a width greater than the same of the third area, a rectangular sixth area located away from the rectangular fourth area by a rectangular fifth area; and the fifth area having a plurality of rectangular contact piece portions spaced away from one another by slits, wherein one end of each of the contact piece portions is connected to the fourth area and the other end is connected to the sixth area, the fourth area and the sixth area being equal in a thickness to each other, each of the contact piece portions of the fifth area being equal in a thickness to one another, both the fourth area and the sixth area having a thickness smaller than a maximum thickness of the contact piece portions of the fifth area.

It is preferable that each of the contact piece portions of the fifth area has a thickness greater at a center thereof than at opposite ends thereof in a longitudinal direction of the contact piece portions of the fifth area.

It is preferable that each of the contact piece portions of the fifth area has a thickness decreasing to opposite ends thereof from a center thereof.

It is preferable that both the fourth area and the sixth area have a thickness equal to a thickness at ends of the contact piece portions of the fifth area.

It is preferable that both the fourth area and the sixth area have a thickness smaller than a thickness at ends of the contact piece portions of the fifth area.

It is preferable that a thickness is gradually reduced from a center of each of the contact piece portions of the fifth area to the ends of both the fourth area and the sixth area.

It is preferable that an inclination angle in a thickness of each of the contact piece portions of the fifth area from a center thereof to one of ends thereof is different from an inclination angle in a thickness of each of the contact piece portions of the fifth area from a center thereof to the other end thereof.

It is preferable that each of the contact piece portions of the fifth area is arcuate with a center thereof being a summit.

It is preferable that each of the fourth area and the sixth area has a uniform thickness.

In still another aspect of the present invention, there is provided a method of fabricating the above-mentioned press-fit type connector terminal, including at least in this order, reducing a thickness of the binders, and bending the binders.

The method in accordance with the present invention includes the step of reducing a thickness of the binders, it is possible to fabricate the binders having a thickness smaller than a thickness of the contact pieces, out of a single metal sheet.

The advantages obtained by the aforementioned present invention will be described hereinbelow.

The press-fit type connector terminal in accordance with the present invention makes it possible to be able to readily bend the binders, even if the binders were short in length. In addition, the press-fit type connector terminal in accordance with the present invention can provide a contact pressure equal to the same provided by binders in the conventional press-fit type connector terminal, and further, makes it possible to design the binders to have a reduced diameter.

The metal sheet and the method both in accordance with the present invention provide the same advantages as mentioned above.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS (First Embodiment)

Figure 8:
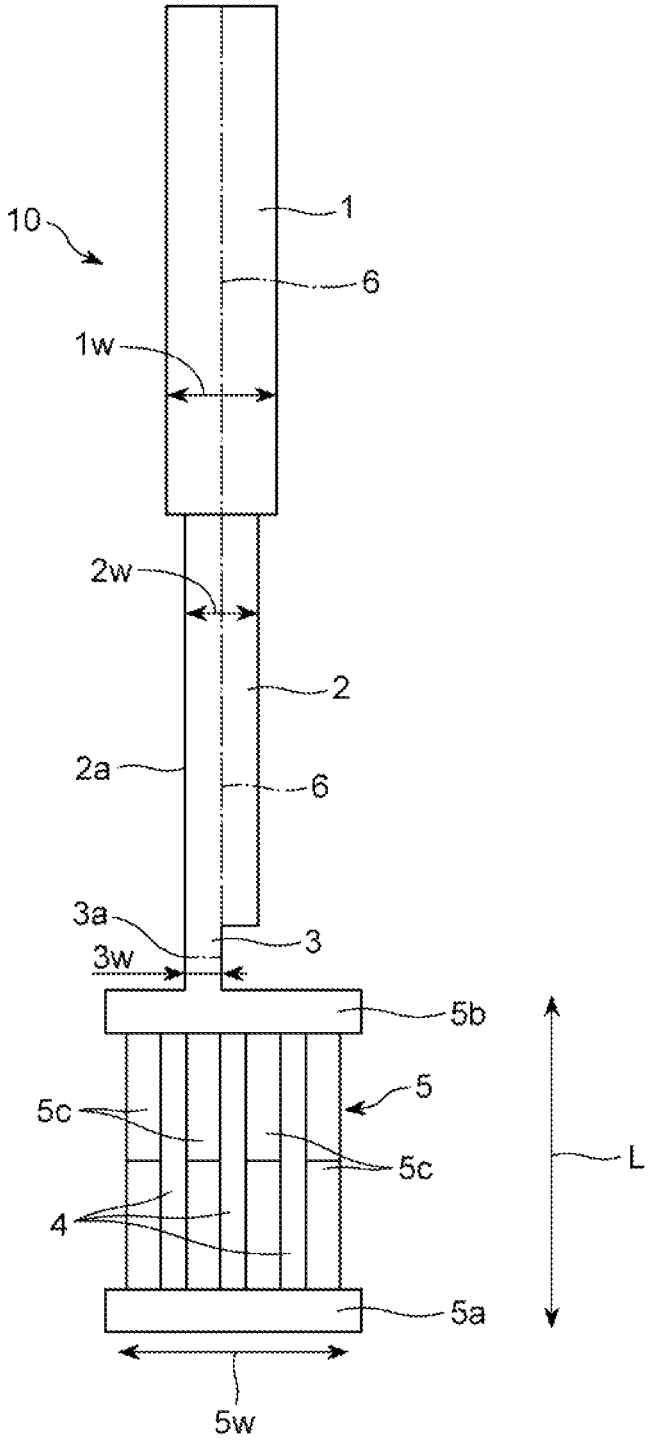
FIG. 8 is a plan view of a metal sheet of which the press-fit type connector terminal in accordance with the first embodiment of the present invention is fabricated.

The press-fit type connector terminal 100 in accordance with the first embodiment is fabricated by bending a single elastic metal sheet 10 illustrated in FIG. 8.

Figure 1:
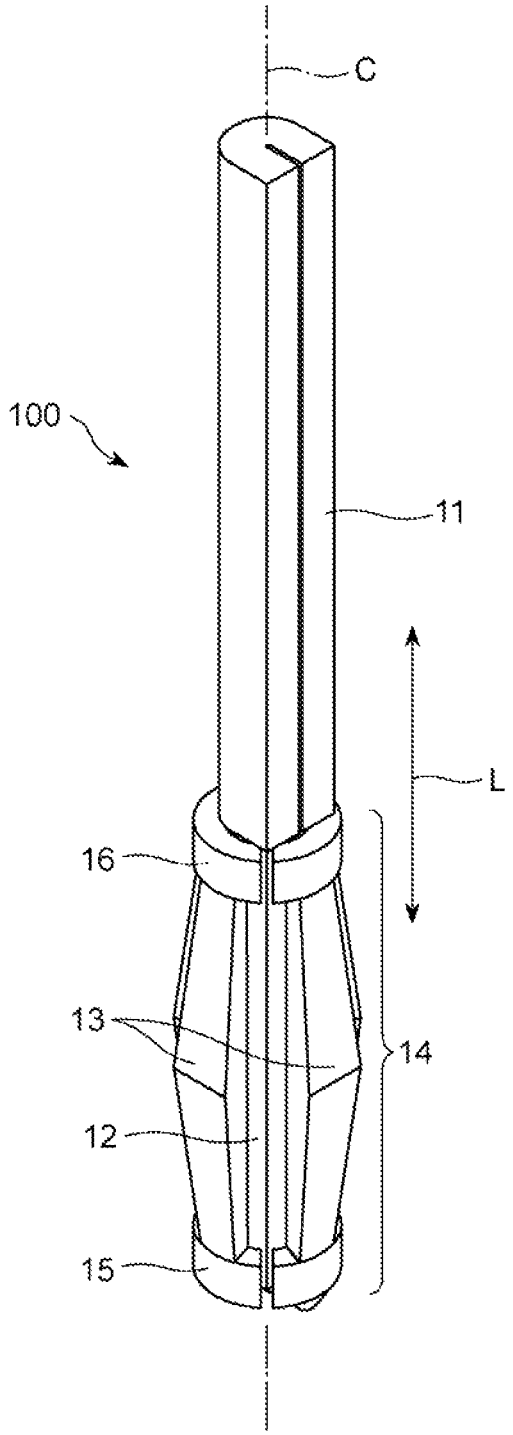
FIG. 1 is a perspective view of the press-fit type connector terminal in accordance with the first embodiment of the present invention.
Figure 2:
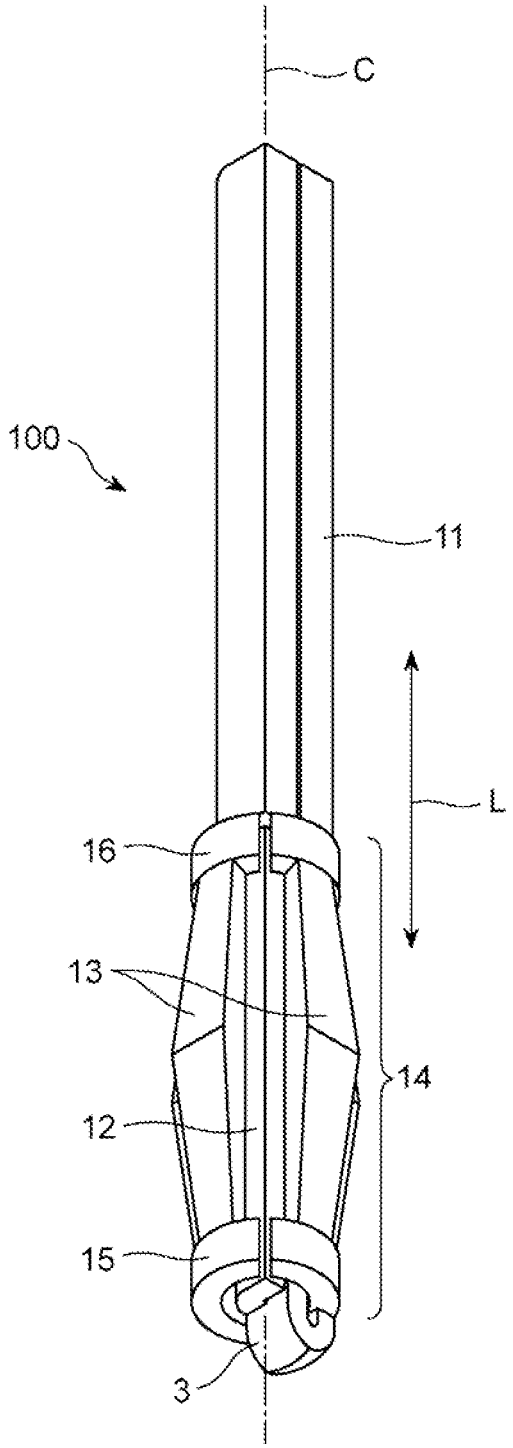
FIG. 2 is another perspective view of the press-fit type connector terminal in accordance with the first embodiment of the present invention.
Figure 3:
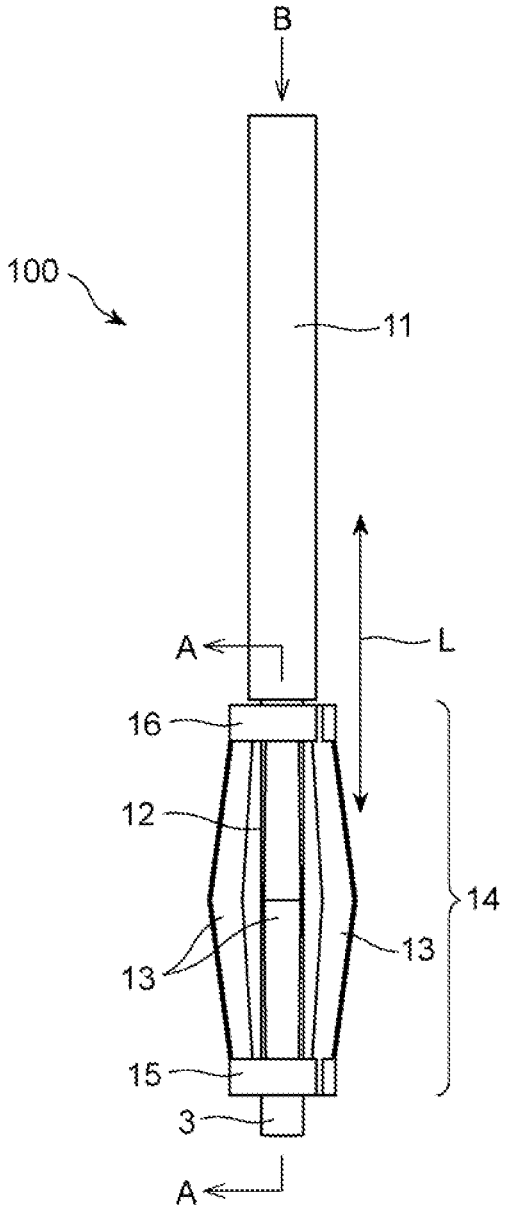
FIG. 3 is a front view of the press-fit type connector terminal in accordance with the first embodiment of the present invention.
Figure 4:
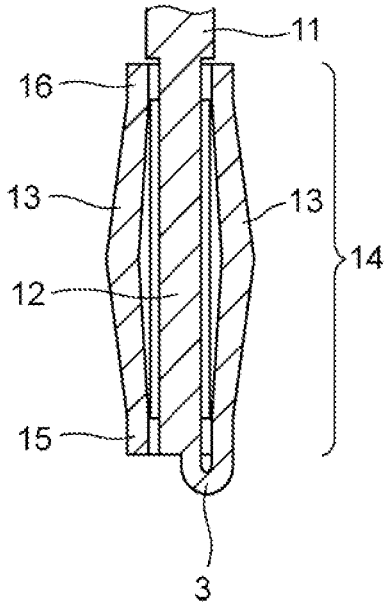
FIG. 4 is a cross-sectional view taken along the line A-A shown in FIG. 3.
Figure 5:
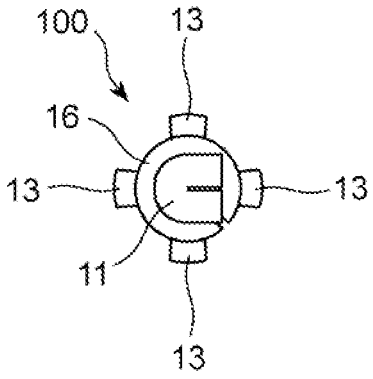
FIG. 5 is a top view of the press-fit type connector terminal in accordance with the first embodiment of the present invention, viewed in a direction indicated with an arrow "B" shown in FIG. 3.

As illustrated in FIGS. 1 to 3, the press-fit type connector terminal 100 includes a pin section 11 having a U-shaped cross-section, a central shaft section 12 extending from an end of the pin section 11, a contact section 14 including a plurality of contact pieces 13 arranged to surround the central shaft section 12 therewith, and a pair of C-shaped binders 15 and 16 each binding the contact pieces 13 at their upper and lower ends and surrounding the central shaft section 12 therewith. The contact pieces 13 extend in a longitudinal direction L of the central shaft section 12, and are bent to outwardly project such that the contact pieces 13 surround the central shaft section 12. The contact pieces 13 are equally spaced away from one another around the central shaft section 12.

The contact section 14 is able to elastically increase and decrease a diameter thereof, because the contact pieces 13 comprising the contact section 14 are deformable in the longitudinal direction L of the press-fit type connector terminal 100.

Figure 6:
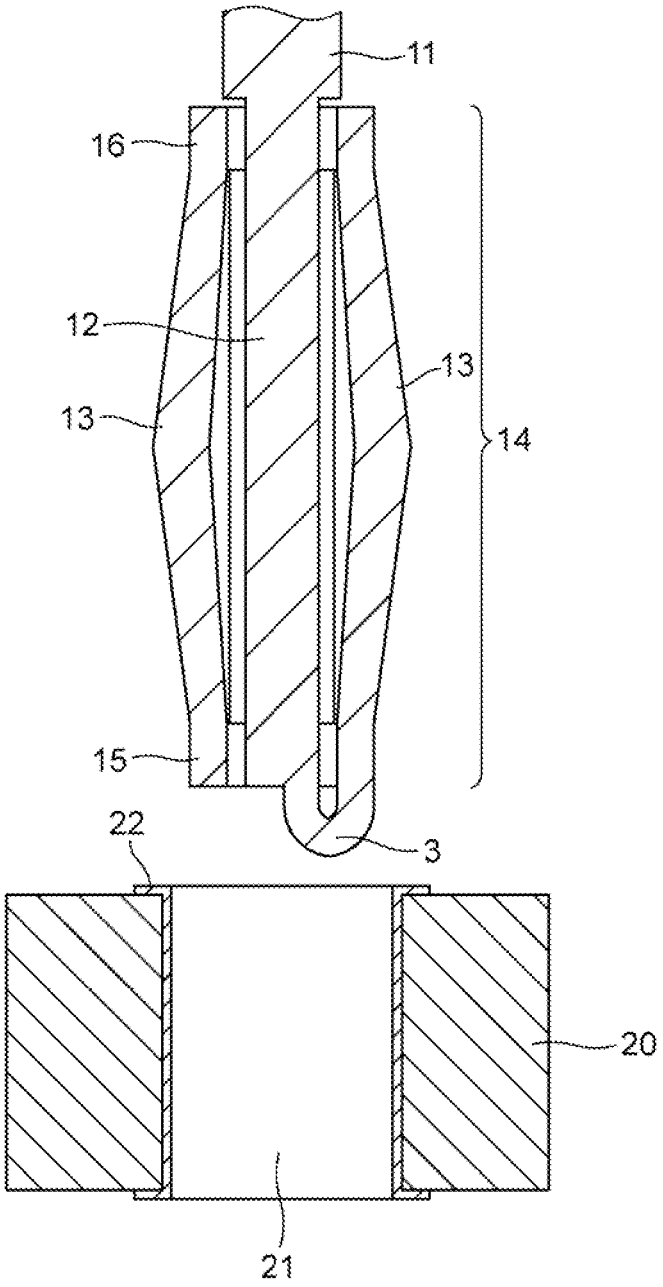
FIG. 6 is a partial cross-sectional view of the press-fit type connector terminal in such a condition as immediately before being inserted into a through-hole formed through a printed circuit board.
Figure 7:
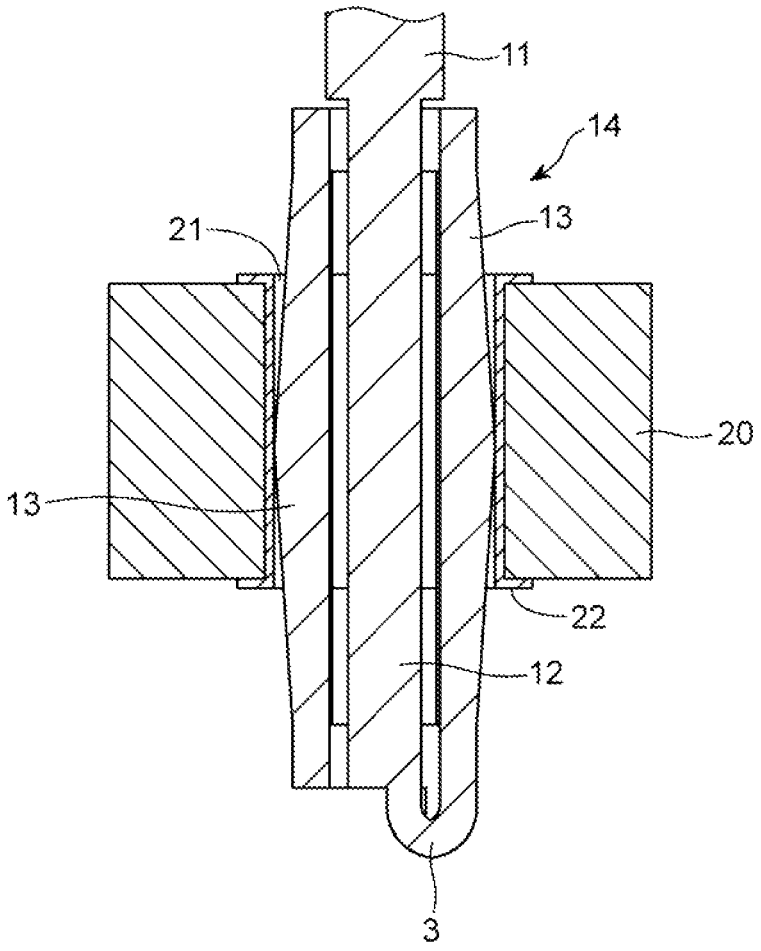
FIG. 7 is a partial cross-sectional view of the press-fit type connector terminal in such a condition as having been inserted into a through-hole formed through a printed circuit board.

As illustrated in FIGS. 6 and 7, when the contact section14 of the press-fit type connector terminal 100 is inserted into a through-hole 21 formed through a printed circuit board 20 and covered with a metal plating 22, the contact pieces 13 comprising the contact section14 are elastically deformed towards the central shaft section 12, and housed in the through-hole 21, ensuring that a force for inserting the contact section 14 into the through-hole 21 can be reduced. Furthermore, since the contact section 14 does not exert an excessive compression force (a contact pressure) on an inner surface of the through-hole 21, the plated surface of the through-hole 21 is prevented from being deteriorated, ensuring that the printed circuit board 20 is avoided from being whitened. In addition, even if the pin section 11 were inclined, the elastic deformation of the contact pieces 13 is suppressed because of the contact of the contact pieces 13 with the central shaft section 12, and hence, the contact pieces 13 are not deformed beyond the elastic deformation limit, ensuring that the contact pieces 13 are not plastically deformed.

Furthermore, since the contact pieces 13 inserted into the through-hole 21 make uniform contact at a plurality of points with an inner surface of the through-hole 21, keeping an elastic force by which the contact pieces 13 are deformed to increase a diameter of the contact section 14, it is ensured that defectiveness in contact between the contact pieces 13 and the through-hole 21 does not occur, and accordingly, superior reliability is provided to the contact between the contact pieces 13 and the through-hole 21.

In addition, as illustrated in FIGS. 1 and 2, since the contact pieces 13 are bound at opposite ends thereof by the C-shaped binders 15 and 16 surrounding the central shaft section 12 therewith, the contact pieces 13 are not spread when and after the contact section 14 is inserted into the through-hole 21, as illustrated in FIGS. 6 and 7, ensuring that reliability in contact between the contact pieces 13 and the through-hole 21 can be enhanced.

The press-fit type connector terminal 100 can be fabricated by bending a single elastic metal sheet 10 illustrated in FIG. 8.

The metal sheet 10 includes a rectangular first area 1 used for fabricating the pin section 11 and extending in the longitudinal direction L, a rectangular second area 2 used for fabricating the central shaft section 12 and extending adjacent to an end of the first area 1 in the longitudinal direction L, a rectangular third area 3 extending adjacent to an end of the second area 2 in the longitudinal direction L, a rectangular fourth area 5*b* used for fabricating the upper binder 16 and extending adjacent to an end of the third area 3 in the longitudinal direction L, a rectangular fifth area 5 spaced away from one another and extending from the fourth area 5*b* in the longitudinal direction L, and a rectangular sixth area 5*a* used for fabricating the lower binder 15 and extending adjacent to ends of the fifth area 5. The fifth area 5 has a plurality of rectangular contact piece portions 5*c* spaced away from one another by slits 4, wherein one end of each of the contact piece portions 5*c* is connected to the fourth area 5*b* and the other end is connected to the sixth area.

The second area 2 commonly has a longitudinal center line with the first area 1, and has a width 2w smaller than a width 1w of the first area 1.

The third area adjacent has a left side extending on an extension of a left side 2*a* of the second area 2, and has a width 3*w* smaller than the width 2*w* of the second area 2. Specifically, the width 3*w* is equal to a half of the width 2*w*.

The horizontally extending fourth area 5*b* has a width greater than the width 3*w* of the third area 3.

The contact piece portions 5*c* of the fifth area 5 are used for fabricating the contact pieces 13, and are equal in length to one another. The contact piece portions 5*c* of the fifth area 5 are equal in a width (a horizontal length) to one another.

The horizontally extending sixth area 5*a* has a width 5*w* (a horizontal length) and a length (a vertical length) both equal to the same of the fourth area 5*b*.

In addition, the contact piece portions 5*c* of the fifth area 5 are equal in a thickness to one another.

Both the fourth area 5*b* and the sixth area 5*a* are designed to have a thickness greater than a maximum thickness of the contact piece portions 5*c* of the fifth area 5.

As mentioned before, the contact section 14 will be required to have a smaller outer diameter with the through-hole 21 (see FIG. 6) being formed smaller. Thus, the binders 15 and 16 in the first embodiment are designed to have a thickness smaller than the same of the contact pieces 13. This ensures that the binders 15 and 16 fabricated by bending the fourth area 5*b* and the sixth area 5*a* can have a reduced diameter, because the binders 15 and 16 are formed thin, even if the binders 15 and 16 are short in length.

Figure 9A:
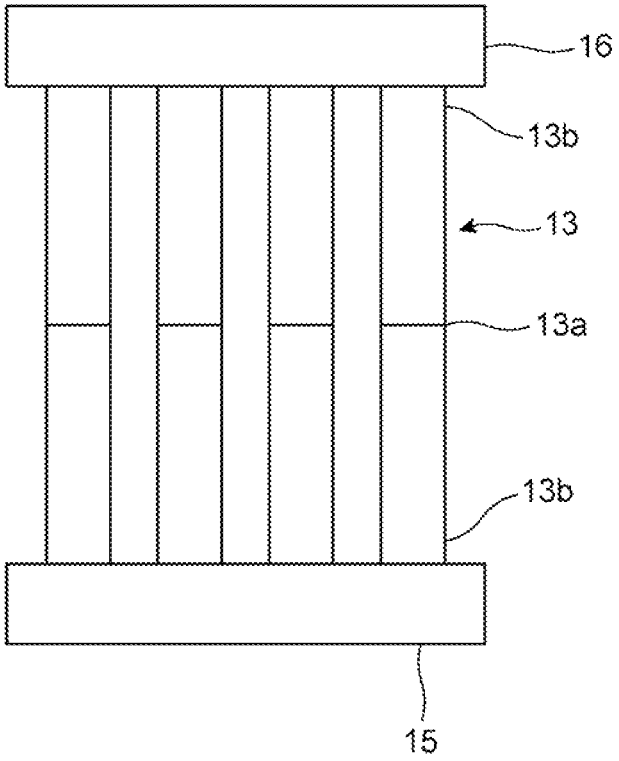
FIG. 9A is a partial plan view of the metal sheet illustrated in FIG. 8, illustrating a portion of the metal sheet for fabricating the contact section.
Figure 9B:
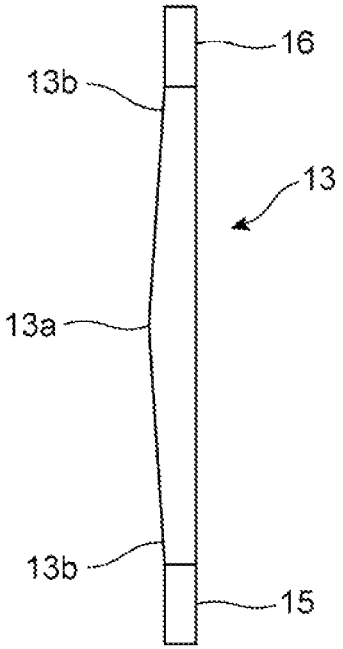
FIG. 9B is a side view of the portion of the metal sheet, illustrated in FIG. 9A.

As illustrated in FIGS. 9A and 9B, the contact pieces 13 in the first embodiment are formed flat at one of surfaces and tapered at the other of surfaces. Specifically, each of the contact pieces 13 has a maximum thickness at a center 13*a* thereof, and has a thickness downwardly inclining towards opposite ends thereof. In other words, each of the contact pieces 13 has a thickness maximum at the center 13*a* and decreasing towards the opposite ends 13*b* thereof.

The binders 15 and 16 are designed to have a uniform thickness in width-wise and length-wise directions, and are equal in a thickness to each other. In addition, the binders 15 and 16 are designed to have a thickness equal to a thickness of the opposite ends 13*b* of the contact pieces 13. Accordingly, the binders 15 and 16 are thinner than a maximum thickness of the contact pieces 13 which is found at the center 13*a* of the contact pieces 13.

The contact pieces 13 are bent to outwardly project, as illustrated in FIGS. 1 to 3. As illustrated in FIG. 7, when the contact section 14 makes contact with the an inner surface of the through-hole 21, the contact pieces 13 are compressed by an inner surface of the through-hole 21, and thus, the contact pieces 13 are elastically deformed to stretch in the longitudinal direction L. As illustrated in FIG. 9B, since each of the contact pieces 13 has a thickness greater at the center 13*a* than at the opposite ends 13*b*, it is possible to avoid deterioration in spring function of the contact pieces 13. Thus, the binders 15 and 16 can be readily bent with a contact load provided by the contact pieces 13 being maintained.

A method of fabricating the press-fit type connector terminal 100 is explained hereinbelow.

First, there are prepared a first die having spaces to define the contact pieces 13 and the binders 15 and 16, and a flat die as a second die. A single metal sheet (not yet punched) is sandwiched between the first and second dies.

Then, the first die is compressed towards the second die to thereby reduce a thickness of portions of the metal sheet from which the contact pieces 13 and the binders 15 and 16 are formed. Since the contact pieces 13 and the binders 15 and 16 are thus made thin at one of surfaces thereof, the metal sheet (not yet punched) can be pressed on the second die (the flat die). That is, the metal sheet can be readily pressed. Furthermore, since the contact pieces 13 can be formed by means of the first die to have a thickness gradually decreasing to the opposite ends 13*b* from the center 13*a*, the contact pieces 13 can be fabricated in a relatively short period of time.

Then, the metal sheet having a varying thickness is punched into the metal sheet 10 illustrated in FIG. 8.

Then, the first area 1 and the second area 2 in the metal sheet 10 are bent around a line 6 extending in the longitudinal direction L to have a U-shaped cross-section. Then, the contact piece portions 5*c* of the fifth area 5 are bent by 180 degrees towards the second area 2 around a line 3*a* horizontally extending across the third area 3.

Then, the fourth area 5*b* and the sixth area 5*a* both extending in a direction perpendicular to the longitudinal direction L are bend to have a C-shaped cross-section, and each of the contact piece portions 5*c* of the fifth area 5 extending in the longitudinal direction L are bent into a "<" shape such that the contact piece portions 5*c* of the fifth area 5 form a barrel to surround the central shaft section 12 therewith.

Thus, the press-fit type connector terminal illustrated in FIGS. 1 to 3 is completed.

As mentioned above, since the C-shaped binders 15 and 16 in the press-fit type connector terminal 100 are formed thin, the binders 15 and 16 can be readily bent, even if they are short in length. Thus, the contact section 14 can be designed to have a reduced diameter relative to the conventional press-fit type connector terminal, maintaining a contact pressure equal to the same provided by the conventional press-fit type connector terminal.

Furthermore, since the binders 15 and 16 are designed to have a uniform thickness, the binders 15 and 16 can be readily bent, and a stress is not concentrated on the binders 15 and 16 when they are bent, ensuring that the binders 15 and 16 can have a sufficient strength after being bent. In addition, since each of the contact pieces 13 is designed to have a thickness decreasing to the binders 15 and 16 from the center 13*a*, the thickness gradually varies, and there is no boundary in the thickness, ensuring no stress concentration on the contact pieces 13.

Furthermore, since the press-fit type connector terminal 100 is fabricated by bending the single elastic metal sheet 10, a number of parts for fabricating the press-fit type connector terminal 100 can be reduced, and further, costs for fabricating the press-fit type connector terminal 100 can be reduced.

(Second Embodiment)

Figure 10A:
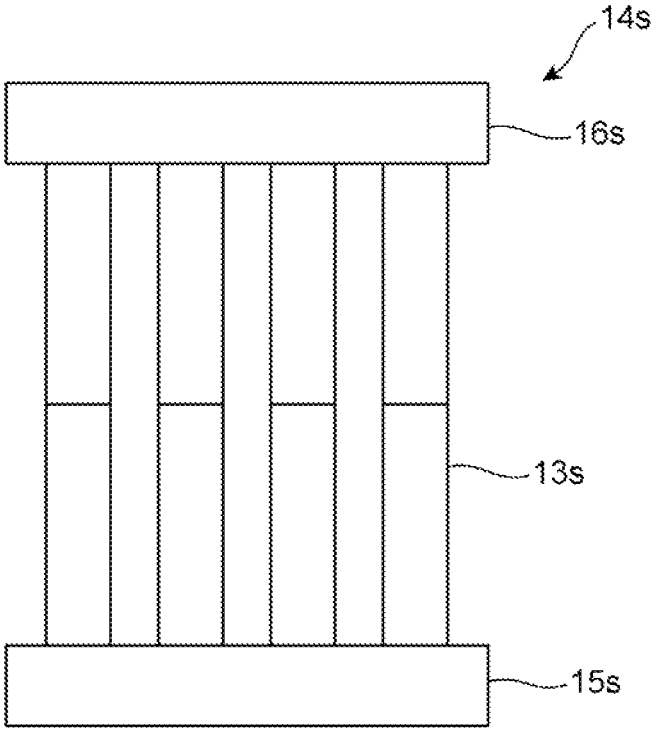
FIG. 10A is a partial plan view of the metal sheet used for fabricating the press-fit type connector terminal in accordance with the second embodiment of the present invention, illustrating a portion of the metal sheet for fabricating the contact section.
Figure 10B:
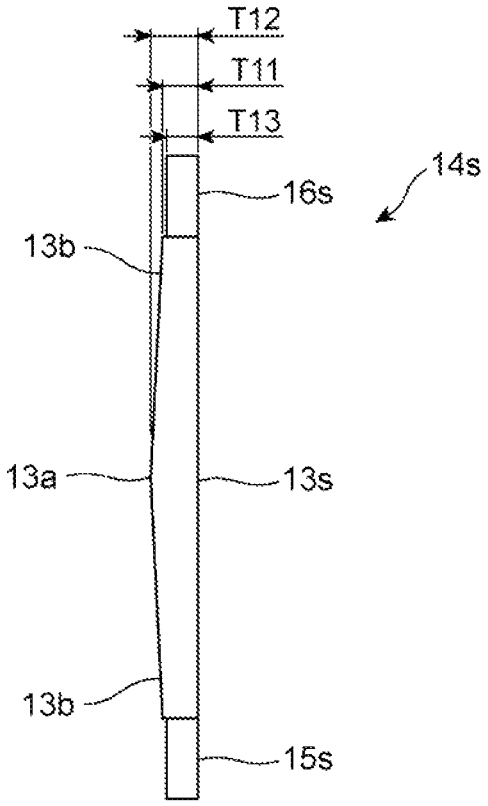
FIG. 10B is a side view of the portion of the metal sheet, illustrated in FIG. 10A.

FIG. 10A is a partial plan view of the metal sheet used for fabricating the press-fit type connector terminal in accordance with the second embodiment of the present invention, illustrating a portion of the metal sheet for fabricating the contact section 14*s*, and FIG. 10B is a side view of the portion of the metal sheet, illustrated in FIG. 10A.

The press-fit type connector terminal in accordance with the second embodiment is designed to include the contact pieces 13*s* in place of the contact pieces 13. The press-fit type connector terminal in accordance with the second embodiment is identical in structure with the press-fit type connector terminal in accordance with the first embodiment except including the contact pieces 13*s* in place of the contact pieces 13.

As illustrated in FIG. 10B, each of the contact pieces 13*s* has a thickness T12 at the center 13*a* and a thickness T11 at the opposite ends 13*b*. The thickness T11 is smaller than the thickness T12, similarly to the first embodiment, but is greater than a thickness T13 of the binders 15*s* and 16*s*, contrary to the first embodiment.

$$T12>T11>T13$$

In the second embodiment, the binders 15*s* and 16*s* are designed to have a thickness smaller than the same of the contact pieces 13*s*. Thus, since the contact pieces 13*s* are relatively thick, the contact section 14*s* including the contact pieces 13*s* can avoid a contact load from being reduced in comparison with the conventional press-fit type connector terminal.

(Third Embodiment)

Figure 11A:
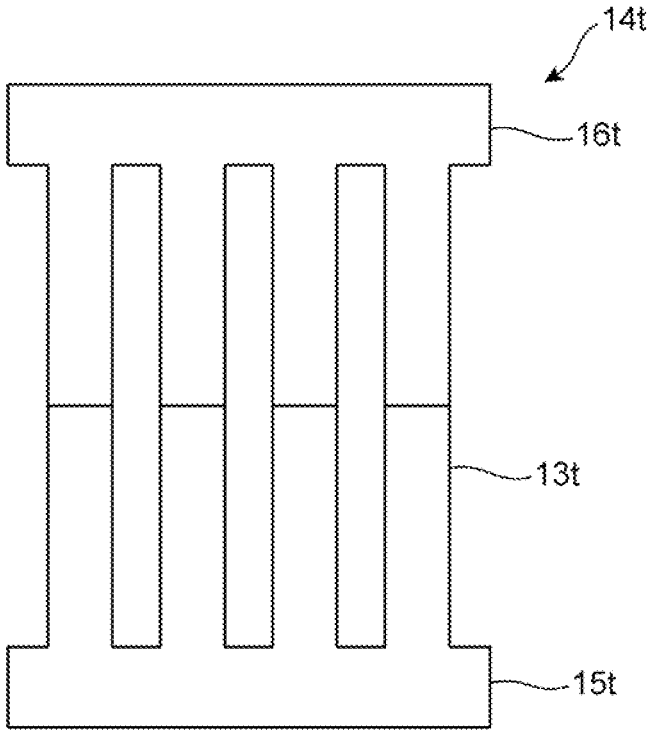
FIG. 11A is a partial plan view of the metal sheet used for fabricating the press-fit type connector terminal in accordance with the third embodiment of the present invention, illustrating a portion of the metal sheet for fabricating the contact section.
Figure 11B:
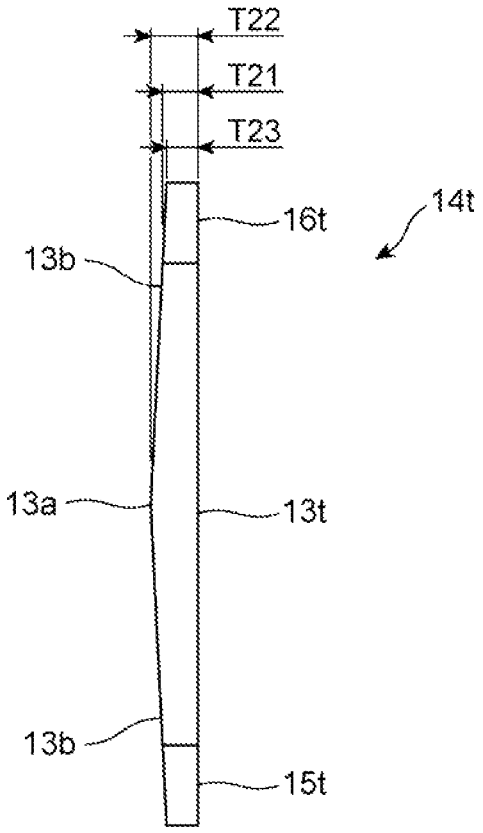
FIG. 11B is a side view of the portion of the metal sheet, illustrated in FIG. 11A.

FIG. 11A is a partial plan view of the metal sheet used for fabricating the press-fit type connector terminal in accordance with the third embodiment of the present invention, illustrating a portion of the metal sheet for fabricating the contact section 14*t*, and FIG. 11B is a side view of the portion of the metal sheet, illustrated in FIG. 11A.

The press-fit type connector terminal in accordance with the third embodiment is designed to include the contact pieces 13*t* in place of the contact pieces 13. The press-fit type connector terminal in accordance with the third embodiment is identical in structure with the press-fit type connector terminal in accordance with the first embodiment except including the contact pieces 13*t* in place of the contact pieces 13.

As illustrated in FIG. 11B, each of the contact pieces 13*s* and the binders 15*t* and 16*t* are designed to have a thickness decreasing from the center 13*a* of the contact pieces 13*a* to the distal ends of the binders 15*t* and 16*t*. Specifically, each of the contact pieces 13*t* is designed to have a thickness T22 at the center 13*a* and a thickness T21 at the opposite ends 13*b*. Each of the binders 15*t* and 16*t* are designed to have a thickness T23 at an end located adjacent to the contact piece 13*t*. The thickness T21 is smaller than the thickness T22, similarly to the first embodiment, but is greater than the thickness T23 of the binders 15*t* and 16*t*, contrary to the first embodiment.

$$T22>T21>T23$$

In the third embodiment, the thickness decreases to the distal ends of the binders 15*t* and 16*t* from the center 13*a* of the contact piece 13*t*. Thus, the thickness gradually varies, and there is no boundary in the thickness, ensuring no stress concentration on the contact pieces 13*t* and the binders 15*t* and 16*t*.

(Fourth Embodiment)

Figure 12A:
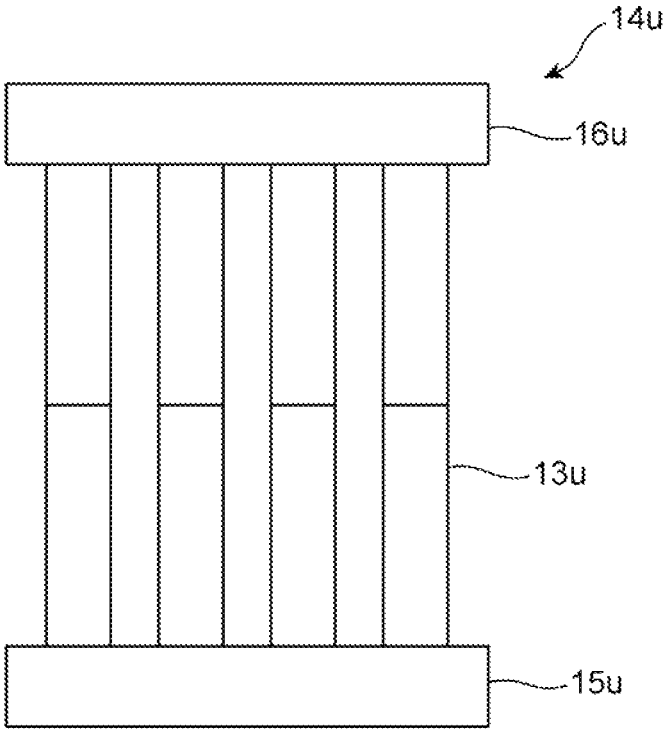
FIG. 12A is a partial plan view of the metal sheet used for fabricating the press-fit type connector terminal in accordance with the fourth embodiment of the present invention, illustrating a portion of the metal sheet for fabricating the contact section.
Figure 12B:
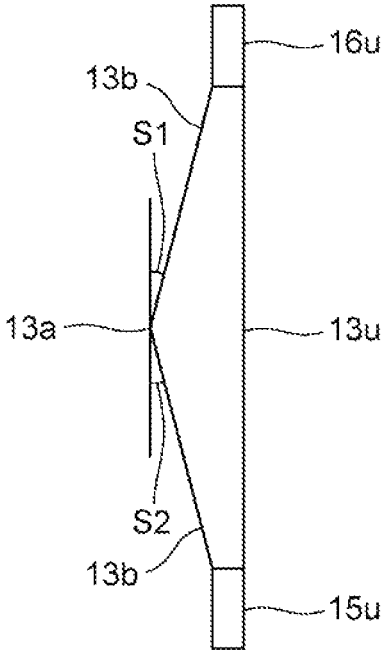
FIG. 12B is a side view of the portion of the metal sheet, illustrated in FIG. 12A.

FIG. 12A is a partial plan view of the metal sheet used for fabricating the press-fit type connector terminal in accordance with the fourth embodiment of the present invention, illustrating a portion of the metal sheet for fabricating the contact section 14*u*, and FIG. 12B is a side view of the portion of the metal sheet, illustrated in FIG. 12A.

The press-fit type connector terminal in accordance with the fourth embodiment is designed to include the contact pieces 13*u* in place of the contact pieces 13. The press-fit type connector terminal in accordance with the fourth embodiment is identical in structure with the press-fit type connector terminal in accordance with the first embodiment except including the contact pieces 13*u* in place of the contact pieces 13.

In the fourth embodiment, an inclination angle S1 formed from the center 13*a* to an end located adjacent to the binder 16*u* and an inclination angle S2 formed from the center 13*a* to an end located adjacent the binder 15*u* are designed to be different from each other. For instance, the inclination angle S2 is designed greater than the inclination angle S1.

By designing the inclination angles S1 and S2 to be different from each other, each of the contact pieces 13*u* has a first strength in the upper half and a second strength in the lower half. For instance, if the plated layer 22 is not uniform in thickness, the contact pieces 13*u* can be formed to adjust the plated layer 22 by designing the inclination angles S1 and S2 to be different from each other.

(Fifth Embodiment)

Figure 13A:
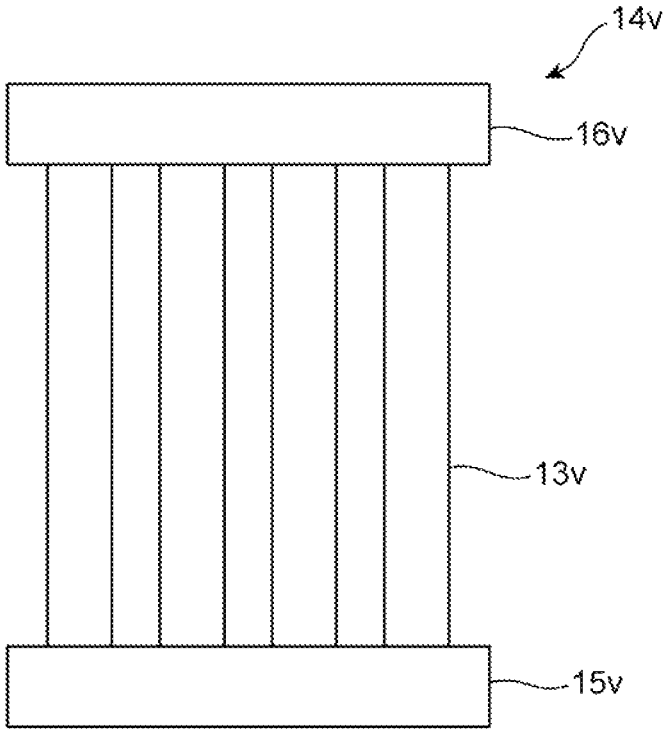
FIG. 13A is a partial plan view of the metal sheet used for fabricating the press-fit type connector terminal in accordance with the fifth embodiment of the present invention, illustrating a portion of the metal sheet for fabricating the contact section.
Figure 13B:
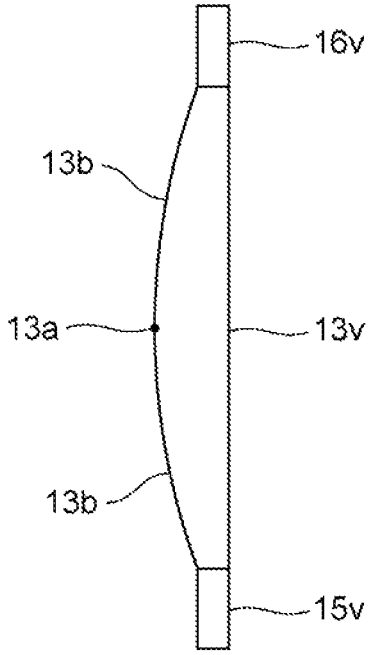
FIG. 13B is a side view of the portion of the metal sheet, illustrated in FIG. 13A.
Figure 14:
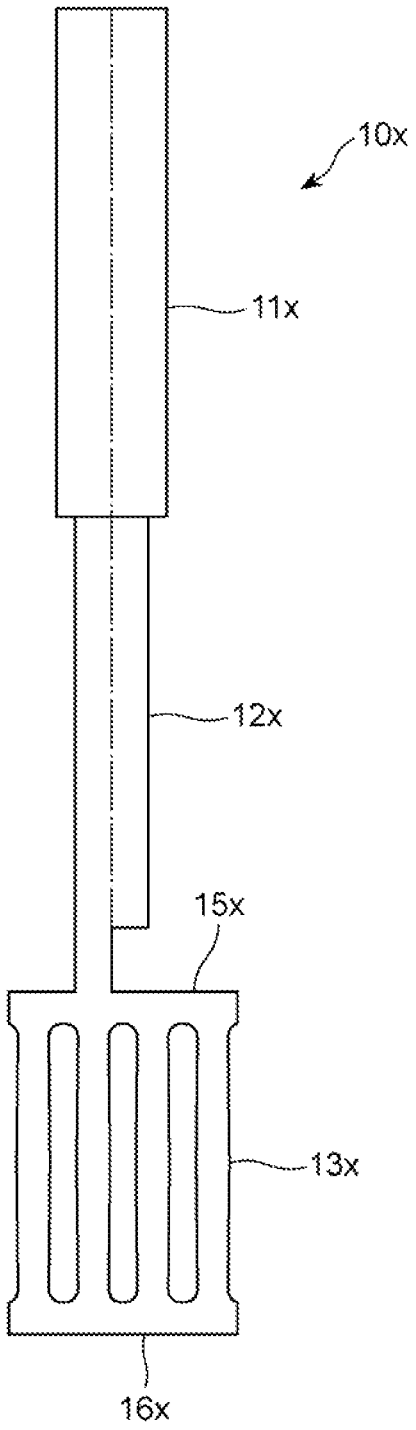
FIG. 14 is a plan view of a metal sheet of which the conventional press-fit type connector terminal illustrated in FIG. 15 is fabricated.
Figure 15:
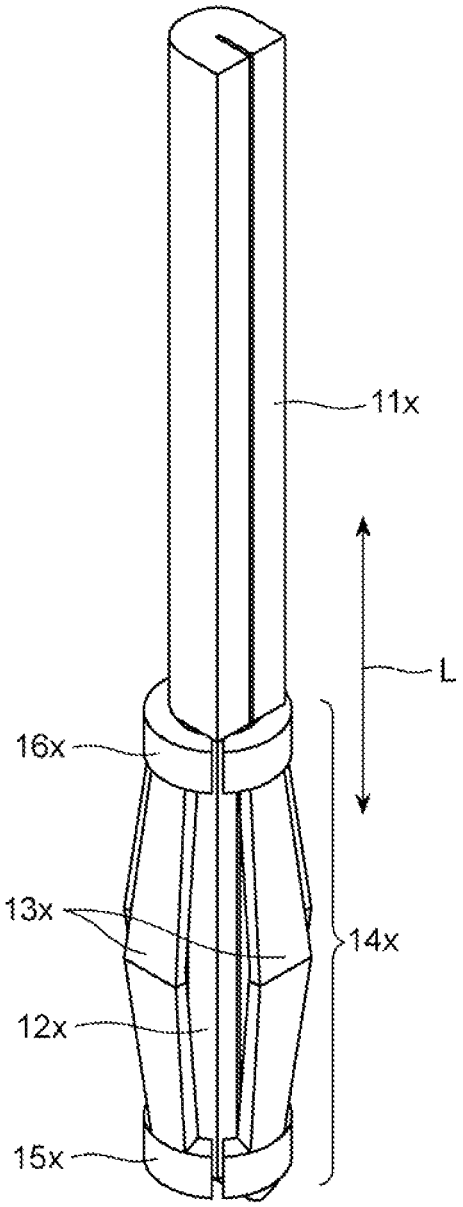
FIG. 15 is a perspective view of the conventional press-fit type connector terminal.

FIG. 13A is a partial plan view of the metal sheet used for fabricating the press-fit type connector terminal in accordance with the fifth embodiment of the present invention, illustrating a portion of the metal sheet for fabricating the contact section 14*v*, and FIG. 13B is a side view of the portion of the metal sheet, illustrated in FIG. 13A.

The press-fit type connector terminal in accordance with the fifth embodiment is designed to include the contact pieces 13*v* in place of the contact pieces 13. The press-fit type connector terminal in accordance with the fifth embodiment is identical in structure with the press-fit type connector terminal in accordance with the first embodiment except including the contact pieces 13*v* in place of the contact pieces 13.

In the fifth embodiment, as illustrated in FIG. 13B, each of the contact pieces 13*v* are arcuate at one of surfaces. Thus, each of the contact pieces 13*v* has a thickness maximum at the center 13*a* thereof and decreasing to the opposite ends 13*b* thereof. Accordingly, the contact pieces 13*v* in the fifth embodiment provide the same advantages as those provided by the contact pieces 13 in the first embodiment.

INDUSTRIAL APPLICABILITY

The press-fit type connector terminal in accordance with the present invention can be employed broadly in various fields such as an electric/electronic device industry and an automobile industry, as a connector to be inserted into a through-hole formed through a printed circuit board.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2013-166761 filed on Aug. 9, 2013 including specification, claims, drawings and summary is incorporated herein by reference in its entirety.

What is claimed is:

1. A press-fit type connector terminal including a contact section configured to be inserted into a through-hole of a printed circuit board, said press-fit type connector terminal being formed of a single elastic metal sheet, said contact section including:

a plurality of contact pieces surrounding a longitudinal center line of said press-fit type connector terminal; and a pair of binders configured to bind said plurality of contact pieces at opposite ends thereof, said pair of binders each having a thickness that is smaller than a maximum thickness of each of said plurality of contact pieces, each of said plurality of contact pieces having said maximum thickness at a central point thereof in a lengthwise direction thereof, a thickness of each of said plurality of contact pieces decreasing to opposite ends of each of said plurality of contact pieces from said central point in said lengthwise direction, and each of said pair of binders having a C-shaped cross-section by which contact surfaces of metal plates defining said plurality of contact pieces are directed outwardly.

2. The press-fit type connector terminal as set forth in claim 1, wherein an inclination angle in said thickness of each of said plurality of contact pieces from a center thereof to a first one of said opposite ends thereof is different from an inclination angle in said thickness of each of said plurality of contact pieces from said center thereof to a second one of said opposite ends thereof.

3. The press-fit type connector terminal as set forth in claim 1, wherein said thickness of each of said pair of binders is equal to said thickness of each of said plurality of contact pieces at said opposite ends thereof.

4. The press-fit type connector terminal as set forth in claim 1, wherein said thickness of each of said pair of binders is smaller than said thickness of each of said plurality of contact pieces at said opposite ends thereof.

5. The press-fit type connector terminal as set forth in claim 1, wherein said thickness of each of said plurality of contact pieces is gradually reduced from a center of each of said plurality of contact pieces to said opposite ends of said of binders.

6. The press-fit type connector terminal as set forth in claim 5, wherein an inclination angle in said thickness of each of said plurality of contact pieces from said center of each of said plurality of contact pieces to a first one of said opposite ends of said pair of binders is different from an inclination angle in said thickness of each of said plurality of contact pieces from said center of each of said plurality of contact pieces to a second one of said opposite ends of said pair of binders.

7. The press-fit type connector terminal as set forth in claim 1, wherein each of said plurality of contact pieces is arcuate with a center thereof being a summit.

8. The press-fit type connector terminal as set forth in claim 1, wherein each of said pair of binders has a uniform thickness.

9. An elastic metal sheet including:

a rectangular first area;

a rectangular second area adjacent to an end of said rectangular first area in a longitudinal direction of said rectangular first area, commonly having a longitudinal center line with said rectangular first area, and having a width that is smaller than a width of said rectangular first area;

a rectangular third area adjacent to an end of said rectangular second area in a longitudinal direction of said rectangular second area, having a side extending on an extension of a side of said rectangular second area, and having a width that is smaller than a width of said rectangular second area;

a rectangular fourth area adjacent to an end of said rectangular third area in a longitudinal direction of said rectangular third area, and having a width that is greater than a width of said rectangular third area;

a rectangular sixth area located away from said rectangular fourth area by a rectangular fifth area; and said rectangular fifth area having a plurality of rectangular contact piece portions spaced away from one another by slits, wherein a first end of each of said plurality of rectangular contact piece portions is connected to said rectangular fourth area and a second end of each of said plurality of rectangular contact piece portions is connected to said rectangular sixth area, each of said plurality of rectangular contact piece portions having a maximum thickness at a central point thereof in a lengthwise direction thereof, a thickness of each of said plurality of rectangular contact piece portions decreasing to opposite ends of each of said plurality of rectangular contact piece portions from said central point in said lengthwise direction, said rectangular fourth area and said rectangular sixth area being equal in thickness to one another, each of said plurality of rectangular contact piece portions of said rectangular fifth area being equal in thickness to one another, and both said rectangular fourth area and said rectangular sixth area having a thickness that is smaller than said maximum thickness of each of said plurality of rectangular contact piece portions of said rectangular fifth area.

10. The elastic metal sheet as set forth in claim 9, wherein said thickness of each of said plurality of rectangular contact piece portions of said rectangular fifth area is greater at a center thereof than at said opposite ends thereof in a longitudinal direction of said plurality of rectangular contact piece portions of said rectangular fifth area.

11. The elastic metal sheet as set forth in claim 10, wherein said thickness of said rectangular fourth area and said thickness of said rectangular sixth area are equal to said thickness at each of said opposite ends of said plurality of rectangular contact piece portions of said rectangular fifth area.

12. The elastic metal sheet as set forth in claim 10, wherein said thickness of said rectangular fourth area and said thickness of said rectangular sixth area are smaller than said thickness at each of said opposite ends of said rectangular fifth area.

13. The elastic metal sheet as set forth in claim 10, wherein said thickness of each of said plurality of rectangular contact piece portions is gradually reduced from said center of each of said plurality of rectangular contact piece portions of said rectangular fifth area to ends of both said rectangular fourth area and said rectangular sixth area.

14. The elastic metal sheet as set forth in claim 10, wherein an inclination angle in said thickness of each of said plurality of rectangular contact piece portions of said rectangular fifth area from said center thereof to a first one of said opposite ends thereof is different from an inclination angle in said thickness of each of said plurality of rectangular contact piece portions of said rectangular fifth area from said center thereof to a second one of said opposite ends thereof.

15. The elastic metal sheet as set forth in claim 10, wherein each of said plurality of rectangular contact piece portions of said rectangular fifth area is arcuate with said center thereof being a summit.

16. The elastic metal sheet as set forth in claim 9, wherein each of said rectangular fourth area and said rectangular sixth area has a uniform thickness.

17. A method of fabricating a press-fit type connector terminal as set forth in claim 1, including at least in this order:

processing said pair of binders to have said thickness that is smaller than said maximum thickness of each of said plurality of contact pieces;

bending said pair of binders such that each of said pair of binders has said C-shaped cross section by which said contact surfaces of said metal plates defining said plurality of contact pieces are directed outwardly; and assembling said press-fit type connector terminal.

* * * * *